United States Patent [19]

Sugano

[11] Patent Number: 4,726,003

[45] Date of Patent: Feb. 16, 1988

[54] TABLE CLOCK

[75] Inventor: Hisako Sugano, Tokyo, Japan

[73] Assignee: Seikosha Co., Ltd., Tokyo, Japan

[21] Appl. No.: 878,035

[22] Filed: Jun. 24, 1986

[30] Foreign Application Priority Data

Jun. 27, 1985 [JP] Japan ..... 60-98296

[51] Int. Cl.[4] ..... G04B 37/00

[52] U.S. Cl. ..... 368/276; 368/316; 248/416

[58] Field of Search ..... 368/316, 276; 248/416, 248/114–116

[56] References Cited

U.S. PATENT DOCUMENTS 3,727,397 4/1973 Ethier ..... 368/316

FOREIGN PATENT DOCUMENTS 138179 1/1903 Fed. Rep. of Germany .

301539 12/1915 Fed. Rep. of Germany ..... 368/316

105528 7/1924 Switzerland ..... 368/316

*Primary Examiner*—Bernard Roskoski

*Attorney, Agent, or Firm*—Bruce L. Adams; Van C. Wilks

[57] ABSTRACT

A timepiece is supported at the distal end portion of a support pole. The support pole is turnable around the opposite proximal end portion thereof which is disposed on a flat surface to define an angle between the support pole and the flat surface. A support plate is slideable along the length of the support pole for supporting the support pole on the flat surface and for effecting adjustment of the angle between the support pole and flat surface so that the timepiece can be adjustably positioned at a desired height and attitude relative to the flat surface.

12 Claims, 2 Drawing Figures

TABLE CLOCK

BACKGROUND OF THE INVENTION

The present invention relates to a table clock.

Table clocks have heretofore been proposed in which the angle of the front face of the time indicating portion can be changed by passing a rod through the time piece in such a manner that the rod is movable back and forth, the rod being provided at opposite ends with spherical support members. In the table clock of this type, the angle of the front face of the time indicating portion can be changed in the following manner: the front face is made substantially erect by positioning the time piece adjacent to the front end of the rod and standing the clock on its bottom portion with the support member positioned at the rear end of the rod. The front face of the clock is slanted at the maximum angle such that it is turned upward when the time piece is positioned near the rear end of the rod. The front face of the time indicating portion can be turned downward by standing the clock on its bottom portion with the support member positioned at the front end of the rod.

Such a conventional clock as described in the above may have the angle made by its front face varied. However, the range of variation in the angle is not large.

SUMMARY OF THE INVENTION

Accordingly, an object of the present invention is to provide a table clock which is capable of having the angle of the front face of its time indicating portion varied and which may act as a form of interior ornamentation.

To this end, there is provided a table clock which comprises a support pole 1, a timepiece 2 provided at the distal end of the support pole in such a manner that it is prevented from sliding in the axial direction of the support pole, and a support plate 4 through which the support pole movably passes.

In the table clock of the present invention, the position of the time piece 2 or the angle of the inclination made by the time indicating portion of the time piece can be changed as desired by sliding the support plate 4 along the support pole 1.

DETAILED DESCRIPTION OF THE INVENTION

Figure 1:
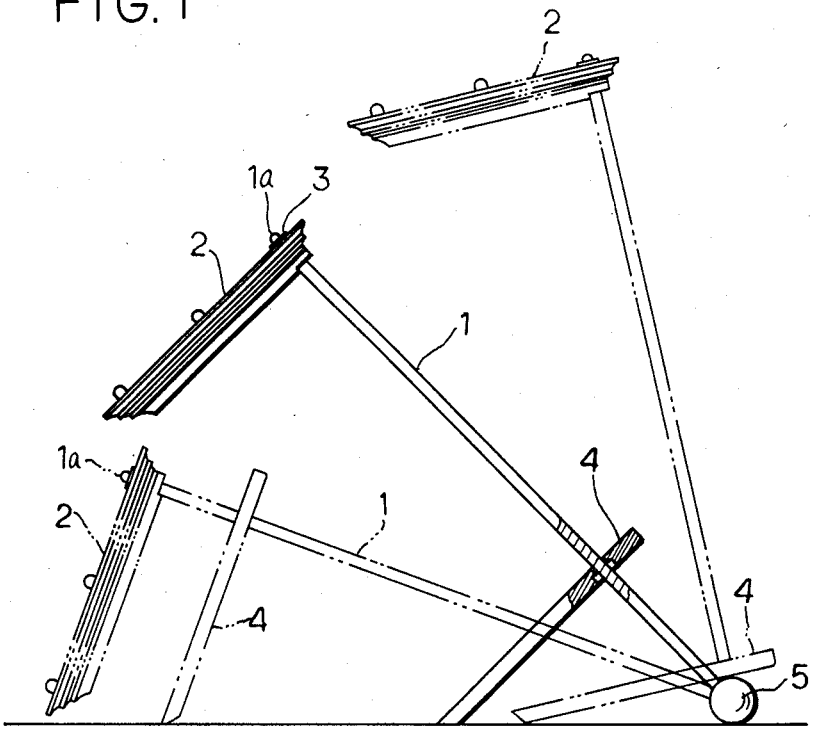
FIG. 1 is a front view of a table clock of the present invention showing various inclined attitudes thereof.

Referring to FIG. 1, supporting means in the form of a support pole 1 is provided with a threaded portion 1*a* at its distal end. This threaded portion passes through a dial 2*a* (FIG. 2) of a time piece 2 at a position located above graduation number "12" on the clock face. A nut 3 is screwed onto this threaded portion in such a manner that the time piece 2 is rigidly fixed to the distal end at a fixed angle relative to the support pole 1 and prevented from sliding in the axial direction of the support pole 1.

The support pole 1 passes through a through-hole provided in adjusting means in the form of a circular support plate 4 so that the support plate 4 can be slideably moved along the length of the support pole 1. If the support pole 1 passes through the circular support plate 4 at its center, the timepiece 2 could be turned freely by rotating the circular support plate 4.

In such a case, however, the angle of inclination of the timepiece 2 cannot be changed to any substantial extent. Such a structure may also lower the stability of the timepiece switch.

Figure 2:
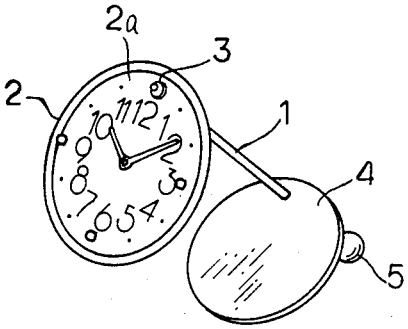
FIG. 2 is a perspective view of the table clock of the present invention.

In order to obviate this problem and support the time piece stably, the support pole 1 passes through the support plate 4 at a position which deviates from the center, as shown in FIG. 2. The stability with which the timepiece 2 is supported can be increased by securing a weight member 5 at the proximal end of the support pole 1 about which the support pole 1 is angularly movable relative to a flat surface as shown in FIG. 2. It is possible to avoid damaging the surface on which the timepiece is installed, if the configuration of the weight member 5 is made spherical.

In consequence, the timepiece 2 can be positioned at a desired height and angular attitude relative to the flat surface wherein the timepiece 2 is slanted by means of the support pole 1 and the support plate 4 as shown by the solid line of FIG. 1. As shown by the dotted lines of FIG. 1, the position or the angle of inclination of the time indicating portion of the timepiece 2 can be changed as desired by moving the support plate 4 along the length of the intermediate portion of the support pole 1 to adjust the angle between the support pole 1 and the flat surface.

With the table clock of the present invention, it is possible to change the position or the angle of inclination of the timepiece to a large extent. It also has a unique configuration as an attractive interior ornamentation.

I claim:

1. A table clock comprising: a support pole having a distal end and an opposite proximal end around which the support pole is angularly movable a timepiece secured at the distal end of said support pole such that the timepiece is prevented from sliding in the axial direction of said support pole; and a support plate for slideably receiving therethrough said support pole to adjust the angular position of the support pole around the proximal end thereof.

2. A table clock according to claim 1; wherein said support pole passes through said support plate at a position which deviates from the center of the support plate.

3. A table clock according to claim 1; wherein said support pole is provided at its proximal end with a weight member.

4. A table clock according to claim 3; wherein said weight member comprises a spherical body.

5. A clock comprising: a timepiece for keeping and displaying time; and supporting means for supporting the timepiece on a flat surface and for enabling adjustment of the height and attitude of the timepiece relative to the flat surface, the supporting means having a distal portion attached to the timepiece, a proximal portion turnably supported on the flat surface to enable adjustment of the height and attitude of the timepiece to a desired position, a longitudinally extending connecting portion interconnecting the distal and proximal portions so that turning movement of the proximal portion on the flat surface effects adjustment of the height and attitude of the timepiece to a desired position, and adjusting means supported on the flat surface and slidable lengthwise along the longitudinally extending connecting portion and coacting therewith to maintain the supporting means and timepiece in the desired adjusted position.

6. A clock according to claim 5; wherein the proximal portion comprises a spherical body.

7. A clock according to claim 5; wherein the proximal portion comprises a weight member.

8. A clock according to claim 5; wherein the adjusting means includes means defining a through-hole slidably receiving therethrough the connecting portion of the supporting means.

9. A clock according to claim 8; wherein the adjusting means comprises a circular support plate.

10. A clock according to claim 9; wherein the circular support plate has a through-hole deviated upwardly from the center thereof.

11. A clock according to claim 5; wherein the longitudinally extending connecting portion comprises a pole member.

12. A clock according to claim 5; including fixing means for rigidly fixing the timepiece to the distal portion at a fixed angle relative to the longitudinally extending supporting means.

* * * * *